US008196906B2

(12) United States Patent
Benton et al.

(10) Patent No.: US 8,196,906 B2
(45) Date of Patent: Jun. 12, 2012

(54) LIQUID AERATOR

(75) Inventors: Peter Samuel Benton, London (GB); Robin Loftus, Stroud (GB)

(73) Assignee: Westport Global Limited, Hampshire (GB)

( * ) Notice: Subject to any disclaimer, the term of this patent is extended or adjusted under 35 U.S.C. 154(b) by 903 days.

(21) Appl. No.: 12/224,452

(22) PCT Filed: Feb. 27, 2007

(86) PCT No.: PCT/GB2007/050086

§ 371 (c)(1),
(2), (4) Date: Aug. 26, 2008

(87) PCT Pub. No.: WO2007/096676

PCT Pub. Date: Aug. 30, 2007

(65) Prior Publication Data

US 2010/0025867 A1 Feb. 4, 2010

(30) Foreign Application Priority Data

Feb. 27, 2006 (GB) ..... 0603834.3

(51) Int. Cl.
*B01F 3/04* (2006.01)

(52) U.S. Cl. ..... 261/110; 261/118; 261/DIG. 22; 99/275; 99/323.1

(58) Field of Classification Search ..... 261/110, 261/DIG. 22; 99/275, 323.1
See application file for complete search history.

(56) References Cited

U.S. PATENT DOCUMENTS

| | | | | |
|---|---|---|---|---|
| 2,818,090 | A | 12/1957 | Paroselite | |
| 4,162,129 | A | 7/1979 | Bartholemew, Jr. | |
| 4,211,545 | A * | 7/1980 | Graefe | 71/9 |
| 4,494,452 | A | 1/1985 | Barzso | |

(Continued)

FOREIGN PATENT DOCUMENTS

BE 1 011 84 A7 2/2000

(Continued)

OTHER PUBLICATIONS

Winestuff—wine breather funnel. www.winestuff.com/acatalog/Wine$_{13}$ Breather_Funnel.html, as archived Mar. 3, 2005—accessible through www.archive.org:internet archive Wayback Machine.

(Continued)

*Primary Examiner* — Robert J Hill, Jr.
*Assistant Examiner* — Christopher P Jones
(74) *Attorney, Agent, or Firm* — Carmody & Torrance LLP

(57) ABSTRACT

A fluid aerator (1) comprising a fluid vessel (2) and a pipe (4) extending from the interior of the fluid vessel (2) to the exterior. The pipe (4) has inlet means for permitting liquid to flow into the pipe (4) from the vessel (2) and is closed at its lowermost end but has one or more outlet holes (8) arranged in the wall of the pipe where the fluid exists from the pipe (4). The pipe (4) is movable relative to the vessel (2) between a first position in which the outlet holes (8) are distant from the vessel and a second position in which the outlet holes (8) are closer to the vessel. By means of the movable fluid supply pipe (4) the same fluid aerator can be used both in relation to delivering aerated fluid into a large bottle and to delivering smaller amounts of aerated fluid to a smaller container, such as a wine glass.

20 Claims, 5 Drawing Sheets

U.S. PATENT DOCUMENTS

| | | | | | |
|---|---|---|---|---|---|
| 4,749,527 | A | * | 6/1988 | Rasmusen | 261/76 |
| 5,293,912 | A | | 3/1994 | Wildash et al. | |
| 5,713,263 | A | | 2/1998 | Burks, III | |
| 5,762,833 | A | * | 6/1998 | Gross et al. | 261/93 |
| 5,931,382 | A | * | 8/1999 | Gross et al. | 239/17 |
| D472,096 | S | | 3/2003 | Christianson | |
| D535,559 | S | * | 1/2007 | Kehoe | D9/440 |
| D605,465 | S | * | 12/2009 | Benton et al. | D7/396.2 |
| D619,431 | S | * | 7/2010 | Wax | D7/700 |
| 2004/0149137 | A1 | * | 8/2004 | Francia | 99/276 |
| 2005/0205609 | A1 | * | 9/2005 | Moore | 222/185.1 |

FOREIGN PATENT DOCUMENTS

| | | | |
|---|---|---|---|
| DE | 29723901 | U1 | 8/1999 |
| FR | 2862241 | A1 | 5/2005 |
| SE | 441005 | A | 9/1985 |

OTHER PUBLICATIONS

"Wine Breather" Internet article, [online], Anonymous, Dec. 5, 2004, retrieved from the Internet on Aug. 6, 2007: www.beer-wine.com/product.asp?sectionID=2&CategoryID=179&productID=1357.

* cited by examiner

[Fig. 001]
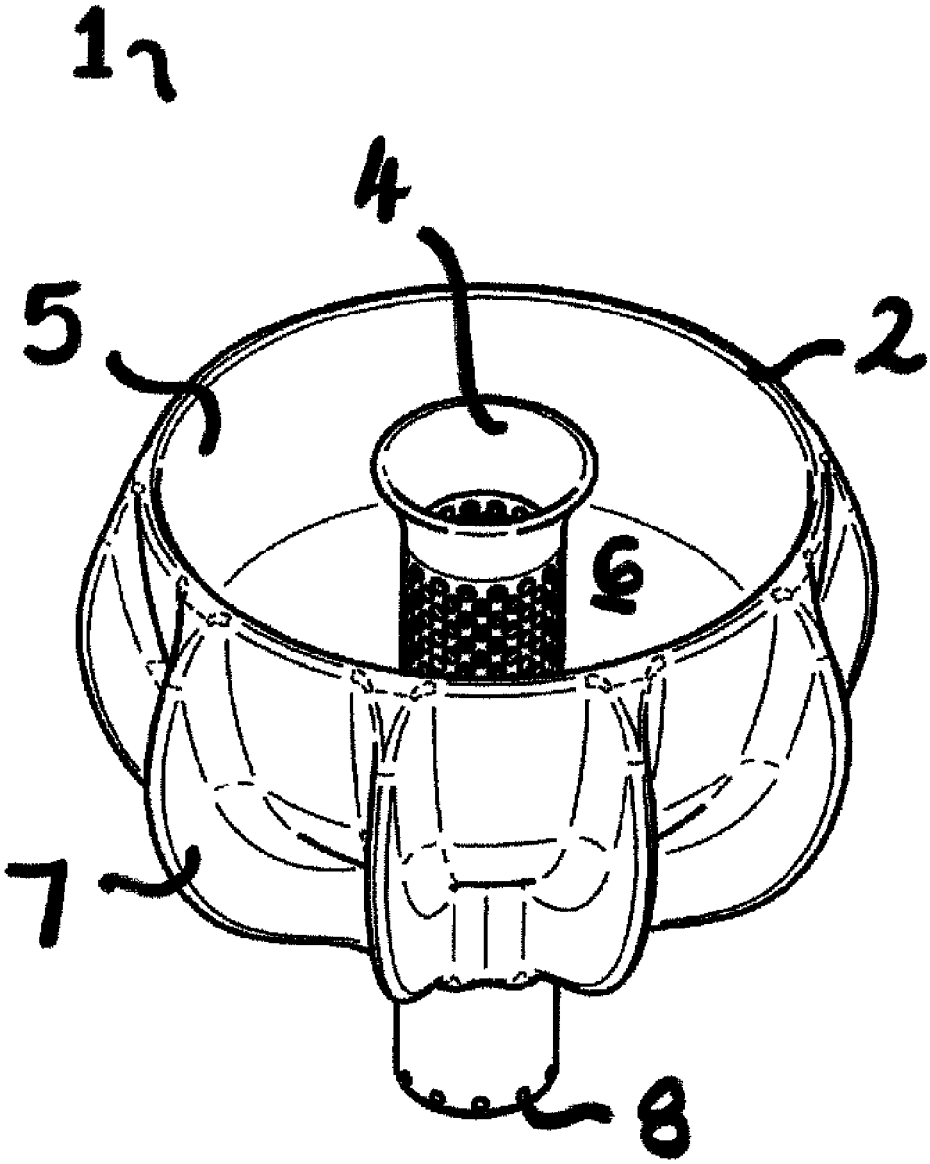

[Fig. 002]
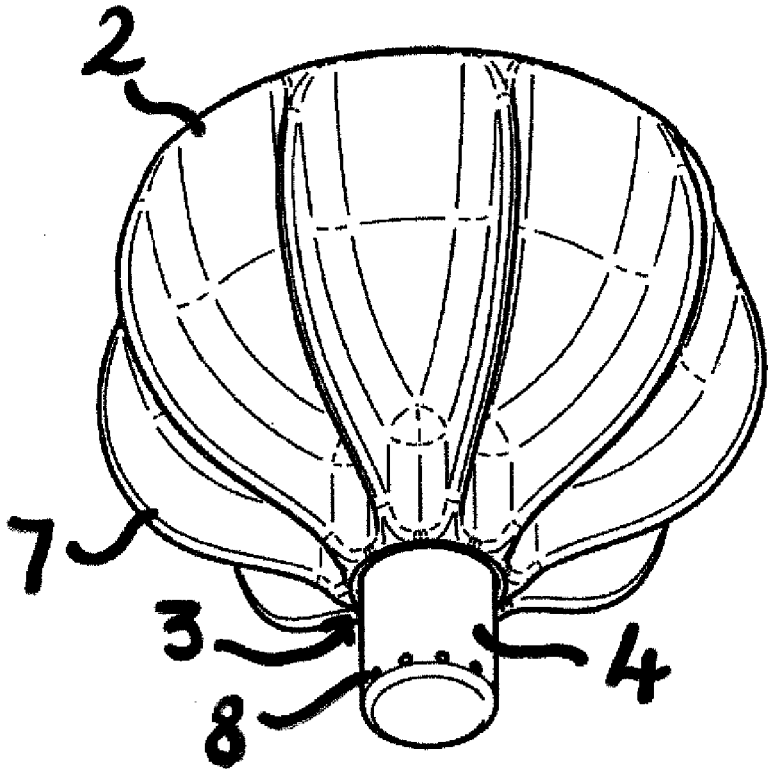

[Fig. 003]
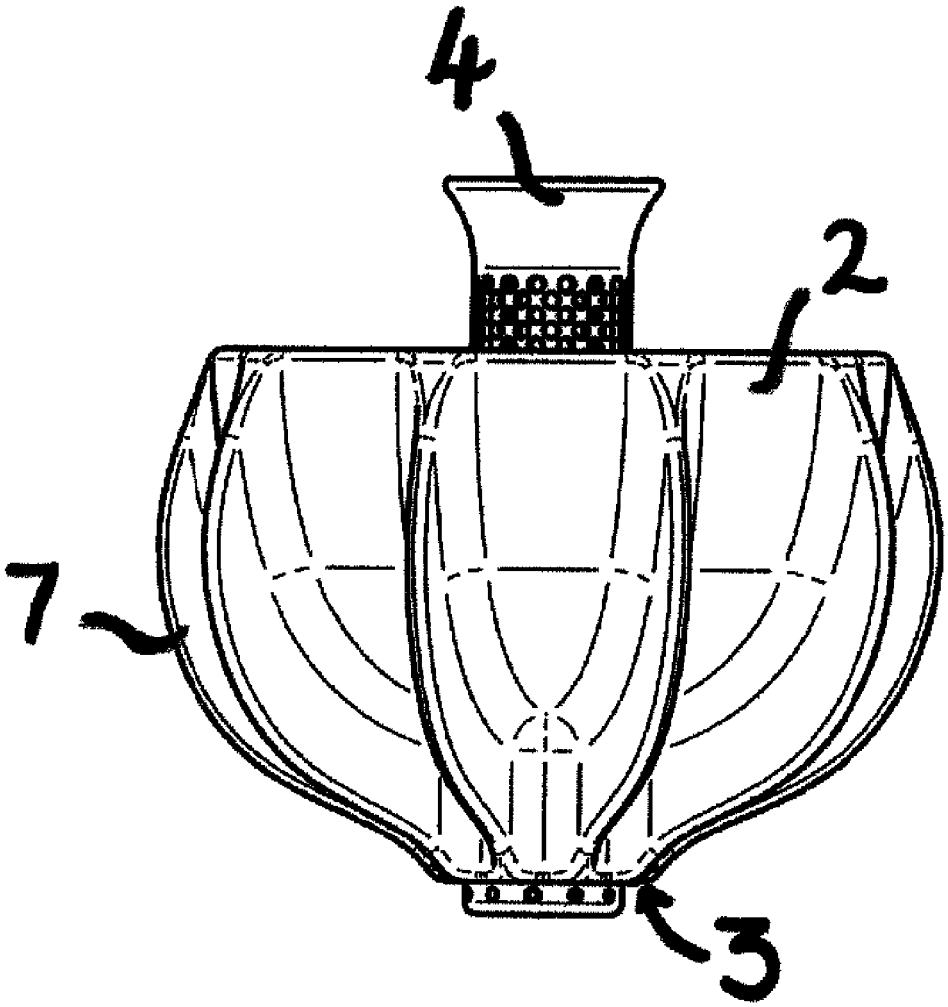

[Fig. 004]
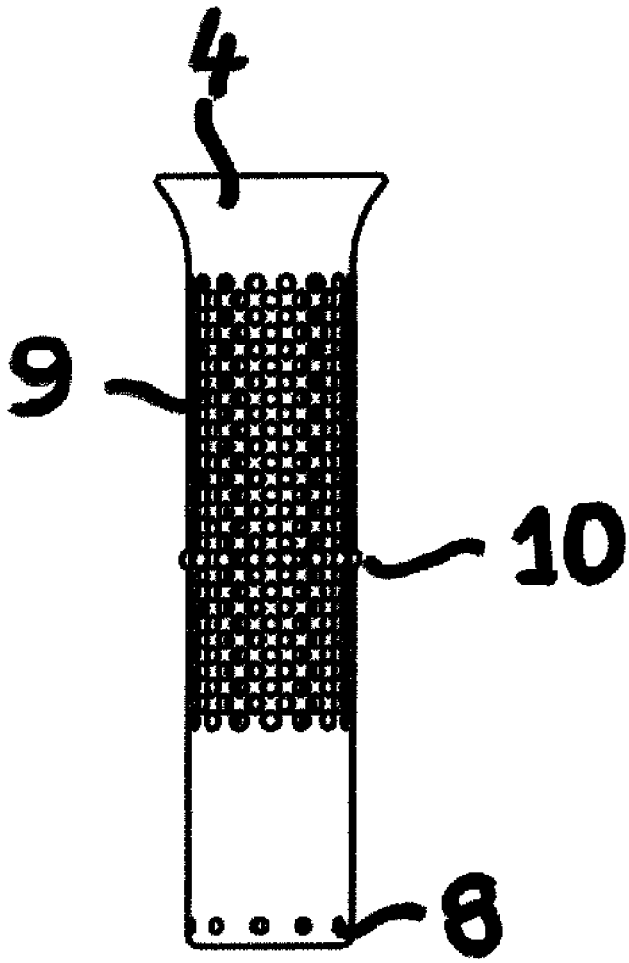

[Fig. 005]
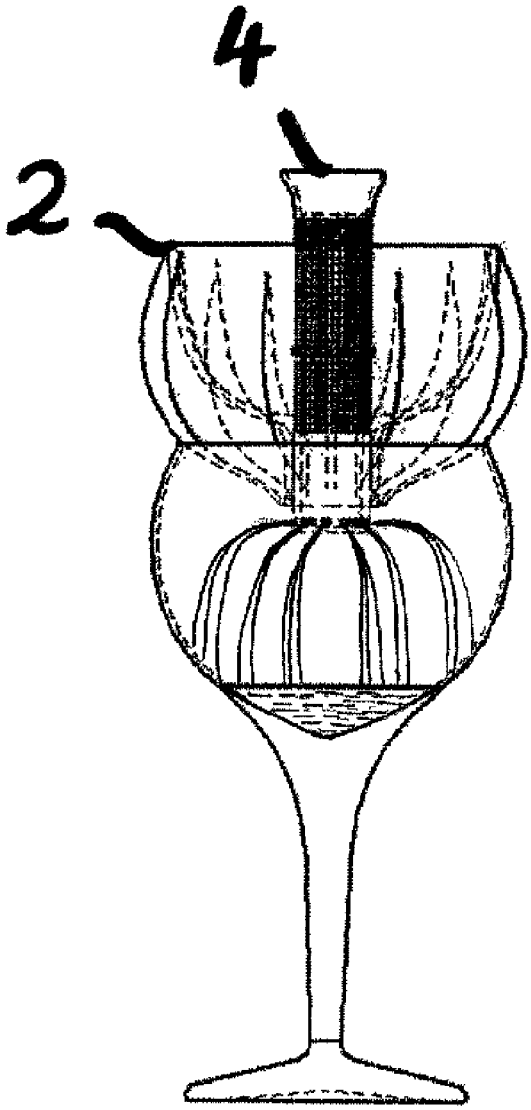

LIQUID AERATOR

CROSS REFERENCE TO RELATED APPLICATIONS

This application is a National Stage application of International Application No. PCT/GB2007/050086, filed Feb. 27, 2007.

TECHNICAL FIELD

The present invention is concerned with a liquid aerator and in particular an aerator adapted for use with small quantities of wine and other beverages known to benefit from aeration.

BACKGROUND ART

It is generally acknowledged that certain beverages, in particular certain wines, improve in flavour if exposed to air prior to drinking. This has the effect of re-oxygenating the wine. Traditionally, wine has been aerated during the decanting of the wine. This generally involves slowly transferring the contents of a wine bottle to a decanter whilst holding the neck of the bottle over a candle or other light source so as to halt the transfer of the wine when residue is seen in the neck of the bottle. More recent wine aerators have sought to automate the aerating process. For example, in FR2862241 the wine receptacle includes an agitator and in U.S. Pat. No. 4,162,129 two receptacles are interconnected to permit fluid to flow from one to the other and are attached to a motor driven oscillator. In U.S. Pat. No. 5,713,263 the wine receptacle is fed by means of a valve controlled funnel. This permits the receptacle to be tipped upside-down so that the wine may be agitated, but without any wine escaping from the end of the funnel. To ensure adequate aeration of the wine, the receptacle in U.S. Pat. No. 5,713,263 is intentionally larger in capacity than a conventional wine bottle so that air remains in the receptacle even when an entire bottle has been emptied into the receptacle.

All of the wine aerators available to date are designed to aerate the entire contents of a bottle of wine at one time. However, increasingly, people are choosing to have an occasional glass of wine at home and do not wish to consume the entire contents of a standard bottle (750 ml). Therefore, the present invention seeks to provide a liquid aerator that is particularly adapted to aerate liquid both in larger volumes, for example 750 ml, and in smaller volumes such as that of a conventional wine glass 125 ml or 175 ml.

DISCLOSURE OF INVENTION

The present invention therefore provides a fluid aerator comprising a fluid vessel and a pipe extending from the interior of the fluid vessel to the exterior, the pipe having inlet means for permitting liquid to flow into the pipe from the vessel and one or more outlet holes arranged in the wall of the pipe below the inlet means, the pipe being at least partially closed at its lowermost end and being movable relative to the vessel between a first position in which the outlet holes are distant from the vessel and a second position in which the outlet holes are closer to the vessel, the fluid aerator further comprising pipe holding means for holding the pipe in at least the first and second positions.

In a preferred embodiment the inlet means and outlet holes are arranged such that the rate of flow of fluid at the outlet holes is substantially the same at both the first and second positions of the pipe.

Ideally, the one or more outlet holes are arranged radially in the wall of the pipe and adjacent the lowermost closed end of the pipe.

In a preferred embodiment the inlet means comprises a perforated region of the pipe and may additionally includes a mesh filter. Alternatively the inlet means may comprise a mesh filter inset into the wall of the pipe or a mesh filter may be provided which extends across the interior of the pipe at a position between the inlet means and the outlet hole.

Ideally, the vessel includes a plurality of fins extending outwardly from the vessel which define air channels therebetween and the one or more outlet holes are arranged with respect to the fins so that the flow of liquid from the outlet holes intersects the flow of air along the air channels.

BRIEF DESCRIPTION OF THE DRAWINGS

An embodiment of the present invention will now be described by way of example only with reference to the accompanying drawings, in which:

FIG. 1 is a perspective view from above of a wine aerator in accordance with the present invention;

FIG. 2 is a perspective view from below of the wine aerator of FIG. 1;

FIG. 3 is a side elevation of the wine aerator of FIGS. 1 and 2 in small quantity delivery mode;

FIG. 4 is a side elevation of the supply pipe of the wine aerator in accordance with the present invention; and FIG. 5 shows a wine aerator in accordance with the present invention, in use.

BEST MODE FOR CARRYING OUT THE INVENTION

In FIG. 1, the wine aerator 1 generally comprises a vessel or collector 2 which is open at its top and has an aperture 3 at its base and a supply pipe 4 which extends through the aperture 3 and is movable relative to the collector 2.

The collector 2 has an inner surface 5, which in the Figures is substantially hemi-spherical, and which describes the boundary of a fluid collecting region 6. It will be apparent that it is not essential for the inner surface 5 of the collector to be hemi-spherical. Alternative shapes, for example frusto-conical, are envisaged for the inner surface of the collector as long as the shape described by the inner surface funnels liquid received in the collector towards the base of the collector.

The outer surface of the collector 2 has a plurality of fins 7 extending outwardly from the collector. The fins 7 increase in size from the top rim of the collector to the aperture 3. At the base of the collector, the depth of the fins 7 corresponds to the length of a guide pipe which fluidly connects the fluid collecting region 6 with the aperture 3. The fluid aerator shown in the Figures has ten fins 7 but it will be immediately apparent that alternative numbers of fins may be employed. The collector diameter, measured to outside of the fins 7, varies. This enables the collector 2 to be mounted in apertures falling within a range of diameters e.g. 3 cm to 10 cm, although larger and smaller diameters are also possible, subject to the size of the collector 2.

An o-ring or other fluid seal (not illustrated) is provided in the interior wall of the guide pipe and engages with the supply pipe 4 which is dimensioned to form a sliding fit with the walls of the guide pipe. Thus, the inner wall of the guide pipe functions as pipe holding means to hold the supply pipe in position relative to the guide pipe. Although the supply pipe 4 is cylindrical in the Figures, alternative shapes for the supply pipe may be employed as long as the guide pipe and aperture 3 match.

As may be more clearly seen in FIG. 2, the supply pipe 4 is closed at its lowermost end. However, a plurality of small feed holes 8 are arranged radially around the wall of the supply pipe adjacent the closed end of the supply pipe. The number and arrangement of the feed holes 8 may be varied. A single small feed hole would provide aeration of the wine but would take time to dispense the wine. Increasing the number of feed holes increases the speed with which the wine can be dispensed without loss of aeration function. The supply pipe 4 need not be fully closed at its lowermost end. Instead, the end of the supply pipe 4 may be adapted to restrict the flow of wine so that wine is caused to flow from both the end of the pipe and the one or more feed holes 8 arranged in the wall of the supply pipe.

Additionally, an upper region 9 of the supply pipe, above the feed holes 8, is perforated to function as a liquid inlet means; the perforations providing fluid passage between the exterior and the interior of the supply pipe 4. Furthermore, as shown in FIG. 4, the supply pipe 4 additionally includes a radially extending rib 10. The rib 10 acts as a detent which engages with the guide pipe so as to restrict further movement of the supply pipe in a downward direction beyond a predetermined position.

As mentioned earlier, the supply pipe is arranged for substantially fluid-sealing but sliding movement relative to the collector 2. In a first position, illustrated in FIGS. 1 and 2, the supply pipe 4 is at its most downward position in which the feed holes 8 are distant from the aperture 3 in the collector. In a second position, illustrated in FIG. 3, the supply pipe is at its uppermost position in which the feed holes 8 are positioned closer, and preferably adjacent, the aperture 3 of the collector. In both the first and second positions the guide pipe acts to hold the supply pipe in these positions and in any position between these two extremes.

In use, as shown in FIG. 5, the wine aerator 1 is positioned in the opening of the receptacle into which the wine or other fluid is to be poured. Where an entire bottle of wine (e.g. 750 ml) is to be aerated, the supply pipe 4 is placed in its first position with the feed holes 8 distant from the aperture 3. Moreover, in this first position the wine aerator 1 is fully capable of handling even larger volumes of wine such as the volumes found with methusaleh and salmanazar sized bottles.

In the illustrated example, only a glass of wine is required and the wine aerator has been placed into the opening of a conventional wine glass with the supply in its second position where the feed holes 8 are adjacent the aperture 3 in the collector. Wine is then poured into the collector 2 and passes from the collector through the perforated region 9 of the supply pipe to the interior of the supply pipe and from there to the feed holes 8. As the feed holes 8 are arranged radially in the wall of the supply pipe, the flow of wine from the feed holes tends to follow a path which initially continues radially away from the feed holes 8 before gradually falling downwardly to the bottom of the glass. As a result of this arrangement of the feed holes in the wall of the supply pipe, the wine is subjected to greater aeration. This is because the passage of the wine through the air in the wine glass is longer than if the wine was poured directly from the bottle into the glass. Also, the division of the flow of wine through multiple small holes 8 ensures a greater percentage of the wine is successfully exposed to air in the glass.

The adjustable position of the supply pipe 4 relative to the collector 2 is required so as to ensure that the feed holes 8 in the supply pipe do not become submerged as the glass or other receptacle is being filled. The first position of the supply pipe 4, in which the feed holes 8 are distant from the aperture 3, generally achieves greater aeration of the wine, as greater air circulation can be achieved. However, by enabling the supply pipe 4 to be movable to a second position where the feed holes 8 are adjacent the aperture 3, it is still possible to ensure aeration of a significant proportion of the wine even where the receptacle is to be filled close to its uppermost edge. In this way, smaller volumes of wine, namely less than 750 ml, and more preferably 250 ml or less, may be aerated directly into a glass or other small volume receptacle.

It will be appreciated that in both positions the rate of flow of wine, or other fluid, at the feed holes 8 is substantially the same.

Optionally, as the wine in the collector 2 will often be dispensed from the collector more slowly than it is poured into the collector, the inner surface of the collector 2 may include one or more markings (not illustrated) to indicate the level to which the collector 2 should be filled with wine in order to dispense a standard wine glass measure (e.g. 125 ml or 175 ml).

Furthermore, it will be apparent that the engagement of the fins 7, provided on the exterior of the collector 2, with the opening of the wine glass or other receptacle defines a plurality of air passages or channels therebetween. Preferably, the fins 7 are arranged so that the air passages are aligned with one or more of the feed holes 8. These air passages are believed to provide additional aeration to the wine as it flows from the feed holes 8. This is believed to be because the flow of wine intersects the natural flow of air along the air passages, resulting in a greater agitation of the air and the wine further increasing the percentage of wine which is successfully exposed to the air.

Thus, it may be seen that the wine aerator describe above is a simple yet efficient means for aerating both larger quantities of wine, such as an entire bottle or more, and smaller quantities of wine such as a single glass. Although reference herein has been specific to the aeration of wine, it will be apparent that the aerator may also be employed to aerate other liquids without adaptation.

In an alternative embodiment of the wine aerator (not illustrated), the perforations 9 in the supply pipe are replaced with a mesh which acts as a filter preventing any residue or other foreign bodies passing from the collector 2 to the feed holes 8. In a further alternative, the mesh may be additional to the perforations or may be arranged to extend across the interior of the supply pipe 4 below the perforated region 9 but above the feed holes 8.

The collector may be made of a metallic material which is substantially inert in the presence of liquids such as wine. Examples of suitable metallic materials are silver or stainless steel. Alternatively, the collector may be made of a hard plastics material. In the latter case, the plastics material is preferably partially translucent so that the collector appears striped as a result of the greater thickness of each of the fins relative to the wall of the collector between the fins. The plastics material may additionally be coloured to emphasise the striped effect.

Further alternatives to the details of the wine aerator described above may be employed without departing from the scope of the invention defined in the accompanying claims.

The invention claimed is:

1. A fluid aerator for aerating a liquid during transfer of the liquid into a container having a floor, the fluid aerator comprising:

a fluid vessel; and a pipe extending from the interior of the fluid vessel to the exterior, the pipe having at least one sidewall and a bottom, wherein the bottom is at least partially closed to restrict the flow of liquid out the bottom of the pipe, the pipe further comprising:

inlet means for permitting liquid to flow into the pipe from the vessel, and one or more outlet holes arranged in the sidewall of the pipe below the inlet means, wherein the pipe is movable relative to the vessel between at least a first position in which the outlet holes are distant from the vessel and a second position in which the outlet holes are closer to the vessel, and the fluid aerator is adapted to hold the pipe's position relative to the fluid vessel in each of the at least first position and the second position while liquid is being transferred from the fluid aerator to the container;

whereby the bottom of the pipe can be prevented from contacting the floor of the container and the at least one or more outlet holes can be prevented from being submerged in the liquid in the container as liquid flows out the one or more outlet holes into the container.

2. A fluid aerator as claimed in claim 1, wherein the inlet means and one or more outlet holes are arranged such that the rate of flow of fluid at the one or more outlet holes is substantially the same at both the first and second positions of the pipe.

3. A fluid aerator as claimed in claim 1, wherein the one or more outlet holes are arranged radially in the wall of the pipe.

4. A fluid aerator as claimed in claim 1, wherein the one or more outlet holes are located adjacent the lowermost closed end of the pipe.

5. A fluid aerator as claimed in claim 1, wherein the pipe forms a liquid seal with the vessel.

6. A fluid aerator as claimed in claim 1, wherein the inlet means comprises a perforated region of the pipe.

7. A fluid aerator as claimed in claim 6, wherein the perforated region additionally includes a mesh filter.

8. A fluid aerator as claimed in claim 1, wherein the inlet means comprises a mesh filter inset into the wall of the pipe.

9. A fluid aerator as claimed in claim 1, wherein a mesh filter extends across the interior of the pipe at a position between the inlet means and the one or more outlet holes.

10. A fluid aerator as claimed in claim 1, wherein the vessel including a plurality of fins extending outwardly from the vessel which define air channels therebetween.

11. A fluid aerator as claimed in claim 10, wherein the one or more outlet holes are arranged with respect to the fins so that the flow of liquid from the outlet holes intersects the flow of air along the air channels.

12. A fluid aerator comprising a fluid vessel and a pipe extending from the interior of the fluid vessel to the exterior, the pipe having inlet means for permitting liquid to flow into the pipe from the vessel and one or more outlet holes arranged in the wall of the pipe below the inlet means, the pipe being at least partially closed at its lowermost end and being movable relative to the vessel between a first position in which the one or more outlet holes are distant from the vessel and a second position in which the one or more outlet holes are closer to the vessel, the fluid aerator further comprising pipe holding means for holding the pipe in at least the first and second positions and the inlet means comprising a perforated region of the pipe.

13. The fluid aerator as claimed in claim 12, wherein the perforated region additionally includes a mesh filter.

14. The fluid aerator as claimed in claim 12, wherein the perforated region comprises a mesh filter inset into the wall of the pipe.

15. The fluid aerator as claimed in claim 12, wherein the inlet means and one or more outlet holes are arranged such that the rate of flow of fluid at the one or more outlet holes is substantially the same at both the first and second positions of the pipe.

16. The fluid aerator as claimed in claim 12, wherein the one or more outlet holes are arranged radially in the wall of the pipe.

17. The fluid aerator as claimed in claim 12, wherein the one or more outlet holes are located adjacent the lowermost closed end of the pipe.

18. The fluid aerator as claimed in claim 12, wherein a mesh filter extends across the interior of the pipe at a position between the inlet means and the one or more outlet holes.

19. The fluid aerator as claimed in claim 12, wherein the vessel includes a plurality of fins extending outwardly from the vessel which define air channels therebetween.

20. The fluid aerator as claimed in claim 19, wherein the one or more outlet holes are arranged with respect to the fins so that the flow of liquid from the one or more outlet holes intersects the flow of air along the air channels.

* * * * *